US005730214A

United States Patent [19]

Beamer et al.

[11] Patent Number: 5,730,214

[45] Date of Patent: Mar. 24, 1998

[54] HEAT EXCHANGER COOLING FIN WITH VARYING LOUVER ANGLE

[75] Inventors: Henry Earl Beamer, Middleport, N.Y.; Timothy Anton Cowell, Luxembourg, Luxembourg

[73] Assignee: General Motors Corporation, Detroit, Mich.

[21] Appl. No.: 784,890

[22] Filed: Jan. 16, 1997

[51] Int. Cl.[6] ..... F28D 1/02

[52] U.S. Cl. ..... 165/152; 165/151; 165/181

[58] Field of Search ..... 165/153, 152, 165/151, 181

[56] References Cited

U.S. PATENT DOCUMENTS

| | | | |
|---|---|---|---|
| 3,003,749 | 10/1961 | Morse | 257/130 |
| 3,250,325 | 5/1966 | Rhodes et al. | 165/153 |
| 3,265,127 | 8/1966 | Nickol et al. | 165/152 |
| 3,993,125 | 11/1976 | Rhodes | 165/153 |
| 4,328,861 | 5/1982 | Cheong et al. | 165/151 |
| 4,593,756 | 6/1986 | Itoh et al. | 165/151 |
| 5,035,052 | 7/1991 | Suzuki et al. | 29/890.046 |
| 5,099,914 | 3/1992 | Reifel | 165/151 |
| 5,176,020 | 1/1993 | Maruo et al. | 72/186 |
| 5,289,874 | 3/1994 | Kadle et al. | 165/152 |
| 5,501,270 | 3/1996 | Young et al. | 165/151 |
| 5,669,438 | 9/1997 | Beales et al. | 165/152 |

*Primary Examiner*—John Rivell
*Assistant Examiner*—Christopher Atkinson
*Attorney, Agent, or Firm*—Patrick M. Griffin

[57] ABSTRACT

A corrugated cooling fin has a louver pattern in which the louvers in a first, lead set, successively increase in tilt angle, moving in the direction of air flow. Matching louvers in a trailing set successively decrease in tilt angle correspondingly. As a consequence, air flow is turned through the lead set, and turned back through the trailing set, in a successive, incremental fashion. The deflected air flow curve is steeper and higher, and the heat rejection rate for the fin increases enough to compensate for an increase in pressure drop across the fin.

3 Claims, 4 Drawing Sheets

HEAT EXCHANGER COOLING FIN WITH VARYING LOUVER ANGLE

TECHNICAL FIELD

This invention relates to corrugated and louvered heat exchanger cooling fins in general, and specifically to such a cooling fin in which the angle of the louvers varies within the pattern.

BACKGROUND OF THE INVENTION

Automotive heat exchangers, such as parallel flow condensers and radiators, have, for decades, employed thin, corrugated cooling fins or "air centers" brazed between the opposed flat surfaces of the heat exchanger flow tubes. This is done in order to enhance the exchange of heat out of the liquid or gas in the flow tubes and into a forced stream of cooling air pulled over the tubes and around the fins. The fin walls are flat and rectangular, and generally have a V shaped relation to one another, although they may be more U shaped and parallel, as well. In either case, the stream of air pulled over the fins generally flows along the length of the fin wall and will, without some means to prevent it, develop a laminar flow boundary layer along the surface of the fin wall as it flows. This potentially degrades the thermal transfer efficiency. As a consequence, almost all fins used in practice are enhanced by a pattern of so called louvers bent out of the fin walls. The louvers are intended to "cut" or break up the air insulative boundary layers that could otherwise form at the surface of the fin walls. Also, louvers, by their very nature, tend to present more of the surface area of the fin directly to the air flow, enhancing conduction.

A typical louvered cooling fin is shown in FIGS. 1 and 2, indicated generally at 22. Fin 22 has planar fin walls 24 joined in a V shape at crests 26. The length of a fin wall 24 is equal to the length of a crest 26, and the width perpendicular to that. The general direction of the forced air flow would be in the direction shown by the arrows in FIG. 1, although much of that air flow is deflected in a manner described below. The wall to wall separation or "pitch" of the fin walls $P_f$ is regular and even in any particular planar cross section. Each louver 28 is a narrow rectangle bent integrally out of the fin wall 24, and rotated by a shallow tilt angle θ, generally less than thirty degrees, about a central axis that runs lengthwise through the center of the louver 28, square or perpendicular to the crest 26. The length of a louver 28, therefore, is generally perpendicular to the length of a fin wall 24. The pitch $P_l$ of the louvers 28 is also constant. The most common current louvered fin design is a so called "multi-louver" design, in which the louvers 28 are divided into a pattern of alternating, adjacent sets of louvers. Most often, just two sets are used, a lead set indicated generally at L and a trailing set T. The two sets L and T are separated from one another by a central "turn around" rib 30, toward which the two sets of louvers converge. The two sets of louvers are alike in every respect, but for the direction of the tilt angle θ, which reverses at the turn around rib 30. In general, every aspect of the fin 22 and the louvers 28 is uniform, including length, width, orientation and the tilt angle θ. The tilt angle may differ from fin to fin, but is uniform for each particular fin. One known design does show a lead and trailing set of louvers that have differing tilt angles from one another, without explaining the reason why. However, within each leading or trailing set itself, the tilt angle is still uniform. While there is a recognition in the art that the louver tilt angle may vary within an actual pattern of louvers due to manufacturing problems, that is treated as an undesirable anomaly. There is no indication that the tilt angle should vary in any deliberate or regular fashion.

Referring next to FIG. 3, the operation and theory of a conventional multi louver fin is illustrated schematically. When air flows over the fin walls 24, it will initially engage the louvers 28 of the lead set, where it is caught and deflected through the fin wall 24, (deflected upwardly as seen in FIG. 3), substantially at the angle of the lead set of louvers 28. Air so deflected will not absolutely follow the angle of the louvers 28, of course, but will have a resultant velocity as it is impacted by air flowing straight between, and farther from, the surfaces of the fin walls 24. The air flow so deflected can continue through the aligned openings of the louvers 28 of several of the adjacent fin walls 24, as shown by flow lines in FIG. 3. Eventually, air in the deflected stream shown flows between a pair of adjacent turnaround ribs 30 in two adjacent fin walls. From there, air is deflected back at the same angle, but in the opposite direction, and back through the louvers 28 of the trailing pattern in the same way. If all of the air streams were so depicted, they would appear as a series of congruent shallow bell curve shapes.

SUMMARY OF THE INVENTION

The invention discloses a significant departure from conventional louver patterns. While the louvers within each set of the pattern (lead or trailing) are uniform in length, width, pitch, and direction of tilt angle, the size of tilt angle varies from the first to last louver. Specifically, the tilt angle increases (moving in the direction of air flow) in the lead set and decreases similarly in the trailing set. The louvers begin in the lead set (and end in the trailing set ) at a smaller tilt angle, but increase in angle significantly toward the center. On testing, the visible consequences of this change are a significantly steeper and higher curvature in the deflected air flow, which also is deflected through more fin walls. There is also an apparently thinner boundary layer at the surfaces of the louvers themselves. This is thought to be a result of the more gradual, stepwise deflection of the air flow created by the gradually increasing louver angle. As measured, fins with louvers patterned according to the invention have yielded a substantially increased heat rejection rate. The increased rate of heat rejection is large enough, in spite of an accompanying increase in air pressure drop across the fins, to be a significant advantage in use.

BRIEF DESCRIPTION OF THE DRAWINGS

These and other features of the invention will appear from the following written description, and from the drawings, in which.

DESCRIPTION OF THE PREFERRED EMBODIMENT

Figure 1:
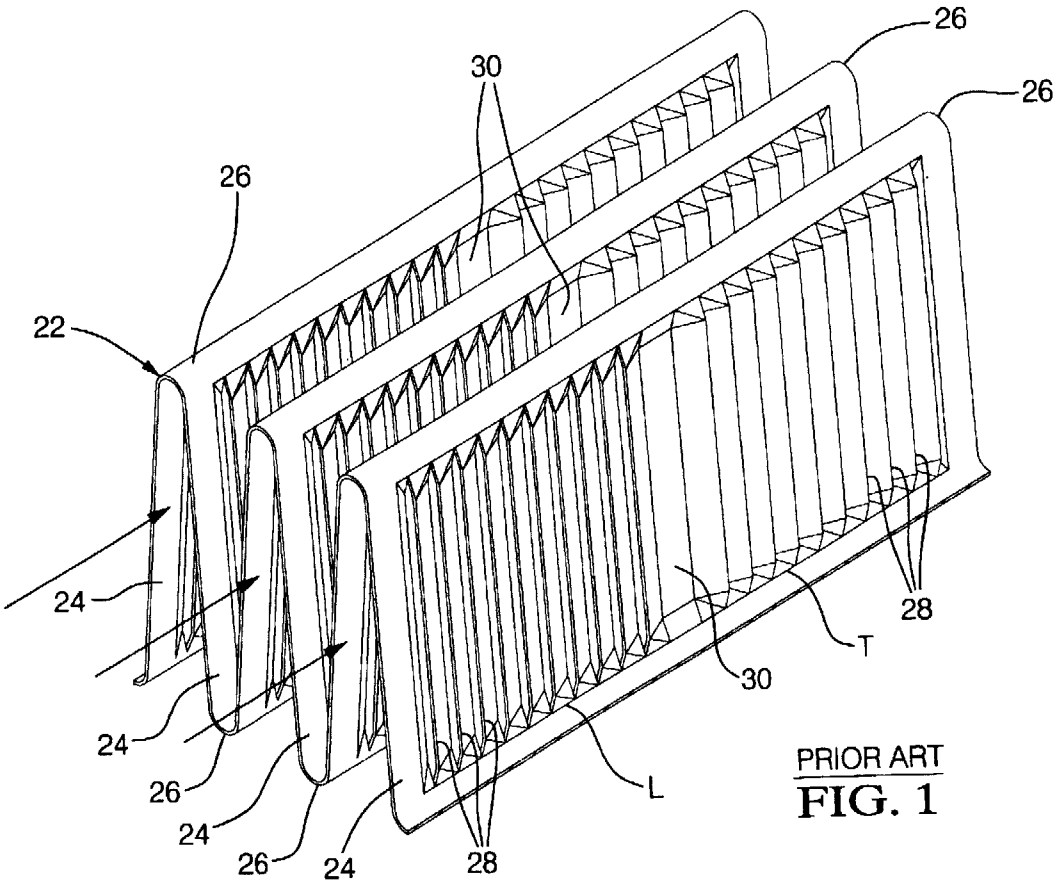
PRIOR ART FIG. 1
FIG. 1 is a perspective view of a typical prior art, multi louver corrugated cooling fin.
Figure 2:
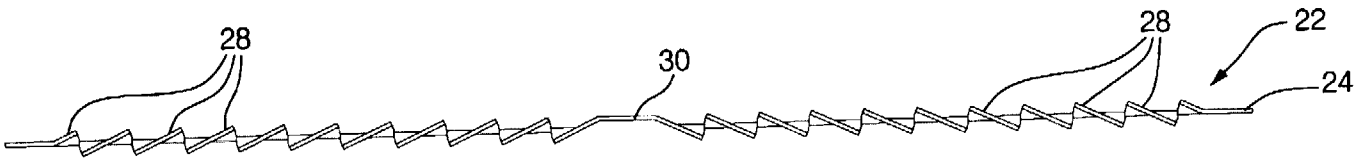
PRIOR ART FIG. 2
FIG. 2 is a cross section taken through one fin wall of the fin in FIG. 1.
Figure 3:
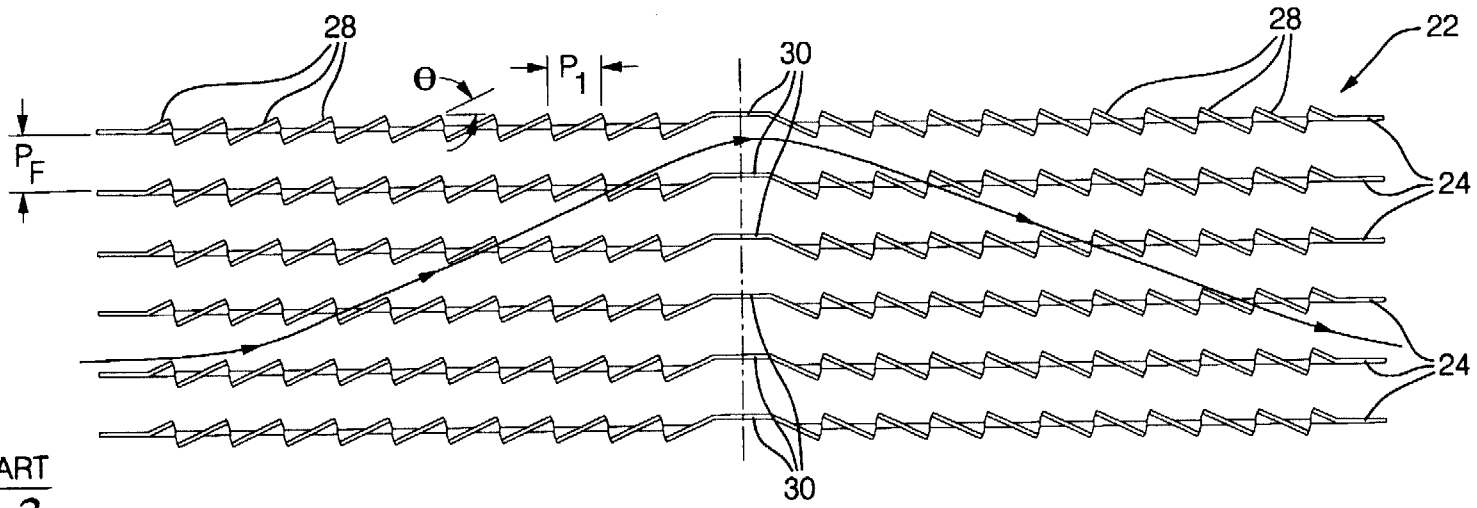
PRIOR ART FIG. 3
FIG. 3 shows the direction of the deflected air flow through several adjacent fin walls of the fin of FIG. 1.
Figure 4:
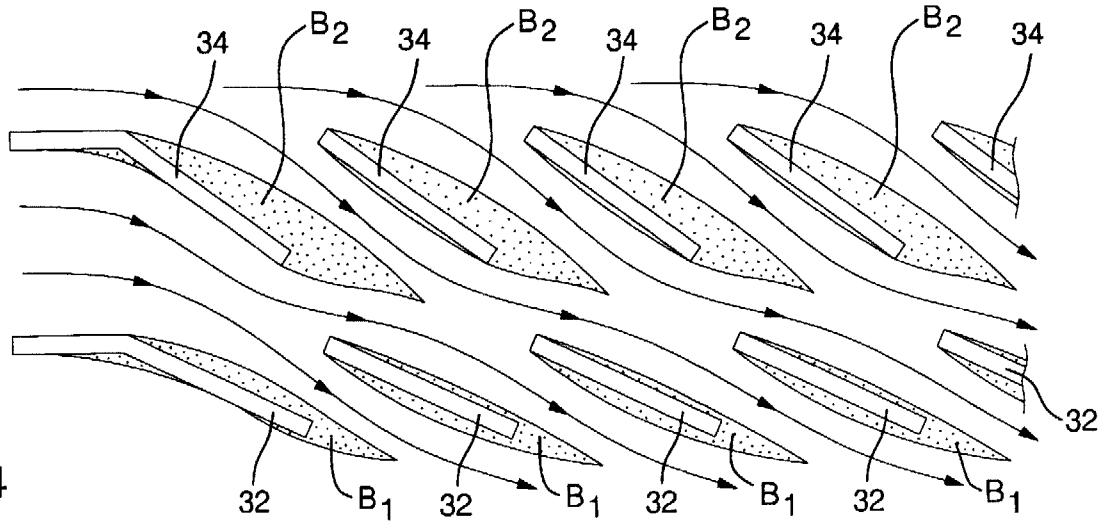
FIG. 4 is a test sample showing two adjacent fin walls, each with louvers that have the same angle, but with one fin wall having steeper louvers then the other, and illustrating the difference in air flow thereover.

Referring first to FIG. 4, a fin test sample, not really representative of either the invention or the prior art per se, illustrates one result of increasing the louver tilt angle. The thickness of the boundary layer at the surface of the louver, indicated by the stippled regions, is affected by the tilt angle. Each louver in a lower set of louvers, indicated at 32, has a shallower tilt angle of approximately twenty-two degrees. Each louver in an upper set, indicated at 34, is steeper at approximately thirty-four degrees. A cooling fin would not actually be made with such a configuration, but the adjacent louvers of widely differing angle does graphically illustrate the difference in air flow. A stream of air tagged with smoke or other visible substance is blown forcefully over the louvers 32 and 34 simultaneously, as shown by the arrows, in the same direction as would occur in an actual heat exchanger. The air stream does not flow absolutely along the surface of either of the louvers 32 or 34. Instead, a boundary layer appears at the surface of each, a thinner layer on the shallower louver 32 indicated at $F_1$, and a thicker layer of the steeper louver 34 indicated at $F_2$. Also, the resistance to the flow (and resultant pressure drop) increases. The air stream is intended to cool the surface of the louver, and thereby draw heat from the fin and the rest of the heat exchanger. Consequently, better and more intimate contact between the air stream and the louver surface (or, conversely, a thinner boundary layer), will yield more efficient heat transfer. However, a shallower angle louver will also deflect the air flow less in a sidewise direction, and, for a given mass flow rate, will not increase the air flow velocity through the fin walls as much. Now, the prior art does recognize the existence of boundary layers, and recognizes a relationship between pressure drop across the fins and louver tilt angle. In general, flow resistance and pressure drop go up with steeper louvers, for a constant air flow rate through the fins. This is because of the increased work the air flow must do to get through the louvered fin. But, up to a point, the enhanced heat rejection rate resulting from steeper angled louvers compensates for the higher pressure drop. However, there appears to be no recognition that, within a given set of louvers, that the louver tilt angle, whether shallow or steep, should be anything but a constant.

Figure 5:
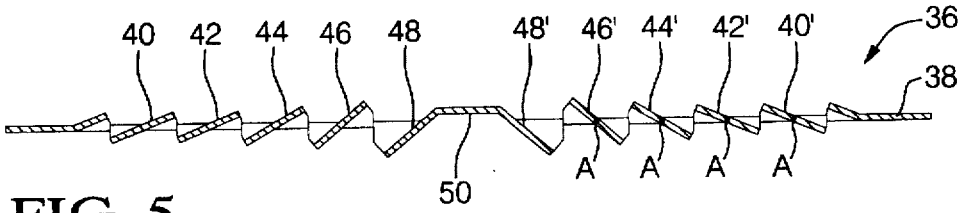
FIG. 5 is a cross section through one fin wall showing the louvers in one embodiment of a fin wall made according to the invention.

Referring next to FIG. 5, one embodiment of a cooling fin made according to the invention is indicated generally at 36. Fin 36, like a conventional fin 22, has planar fin walls 38 joined to one another in V shaped corrugations. Likewise, louvers in an alternating pattern of leading and trailing sets are pierced and bent out of the flat fin walls 38 and tilted about lengthwise axes, one of which is indicated at A. The axes A are perpendicular to the length of the fin wall 38 and the direction of air flow, as with a conventional fin. What is very different, however, is that the tilt angle of the louvers varies within each set of the basic pattern. Specifically, in the lead set, five full louvers 40, 42, 44, 46 and 48 have a steadily increasing tilt angle, moving in the direction of air flow and toward a central turn around rib 50. Here, the tilt angle begins at a typical shallow value of approximately twenty-two degrees for the initial louver 40. From there, the angle climbs steadily across the lead set to approximately forty degrees for the final louver 48. The trailing set has louvers that mirror the lead set in reverse order, with a corresponding decrease in tilt angle, and so are numbered in reverse with a prime (′). The increments of increase (or decrease) across the intermediate louvers are evenly divided so as to give a steady increase or decrease, for each louver, (no two adjacent louvers having the same tilt angle). Alternatively, the total change in tilt angle from first to last louver may be distributed differently, as described in more detail below.

Figure 6:
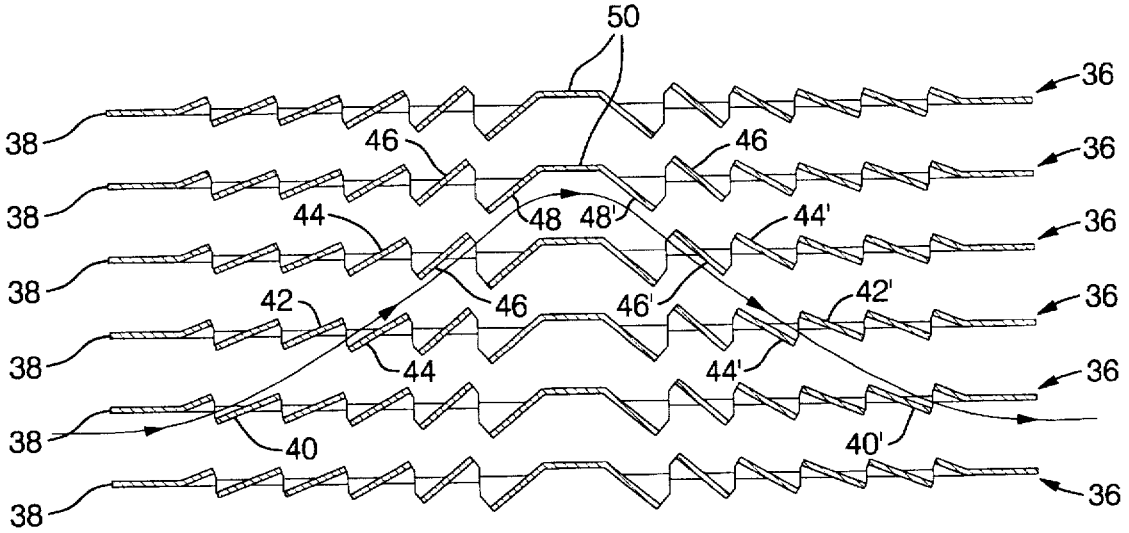
FIG. 6 shows the direction and shape of the deflected air flow though several adjacent fin walls the fin of FIG. 5.

Referring next to FIG. 6, the flow path resulting from the differing louver pattern of the invention is illustrated schematically. Air impinging on the first, shallowest louver 40 in any fin wall 38 (only the flow impinging initially on the second fin wall 38 from the bottom is specifically illustrated) is turned slightly, as it would be turned by any relatively shallow louver, and with a correspondingly thin boundary later (though that is not separately illustrated). Next, the flow impinges on the steeper louver 44 in the next adjacent fin wall 38. With other factors varying, such as a faster or slower air flow, or a different pitch of the fin walls, different louver width or pitch, etc., the deflected air flow might contact a different louver in the next adjacent fin wall, louver 42, for example. In any event, however, it will contact a steeper louver, not a louver with the same tilt angle, as it would in a conventional fin. The steeper louver 44 will turn the flow more, but with less work, and with a thinner boundary layer, than would be the case if a straight flow were impinging upon it. Next, the flow engages louver 46 in the next adjacent fin wall 38, but on the downstream side thereof, and with a similar effect, that is, further turning of the flow. Finally, the steepest louver 48 is engaged. At this point, the flow has been turned into a steeper curve, and deflected sidewise through more fin walls 38, than would have been the case if all of the louvers had been as shallow as the first louver 40. However, the air flow has gotten to that point more efficiently (with less pressure drop) and also with better conformation to the louver surfaces, than it would have if all of the louvers had been as steep as the last louver 48. Once the flow passes between two adjacent turn around ribs 50 in the top two fin walls 38, it reverses direction through the louvers 48–"40′ in the trailing louver sets of the same fin walls 38 it passed through on the way in. As compared to a conventional multi louvered fin with louvers of invariant tilt angle, the increasing angle louvers in successive fin walls all act to turn the flow. Conventionally, the basic flow turning is done primarily by only the first louvers impacted by the flow stream. In addition, the flow turning work is done in incremental, smoother steps, and therefor with less wasted work and pressure drop. The flow is also turned while maintaining a better conformation to the surfaces of the louvers (thinner boundary layers). All of these factors are thought to contribute to the improved performance that has been noted for fins made according to the invention, described farther below.

Figure 7:
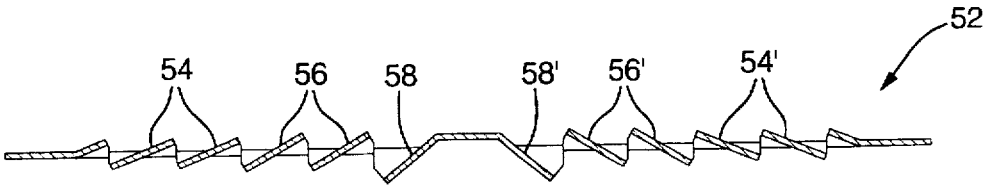
FIG. 7 is a cross section through one fin wall showing the louvers in another embodiment of a fin wall made according to the invention.
Figure 8:
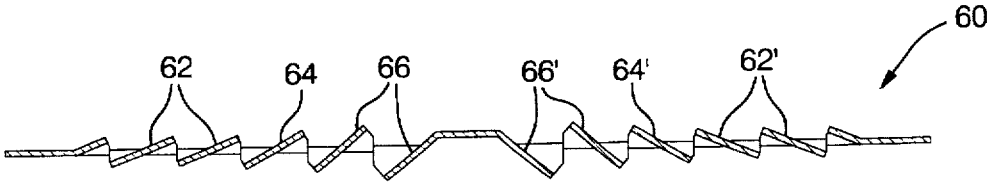
FIG. 8 is a cross section through one fin wall showing the louvers in yet another embodiment of a fin wall made according to the invention.

Before turning to a description of results, it is useful to consider two other less "ideal," but more simply manufactured embodiments of the invention, illustrated in FIGS. 7 and 8. In each, while the louvers' tilt angle increases from first to last across the lead louver set, some adjacent louvers have the same tilt angle, as opposed to distributing the total angular change evenly across each and every louver. In FIG. 7, for example, a corrugated cooling fin indicated generally at 52 has a basic louver pattern in which the first two louvers 54 of the lead set have a shallow tilt angle of twenty-two degrees. The next two louvers 56 are thirty degrees, and the final louver 58 is forty degrees. The louvers in the trailing set, 58' through 54', decrease in angle correspondingly. The total angle change, first to last, is the same as fin 36, but is distributed less evenly. In the other embodiment, fin 60 in FIG. 8, the first two louvers 62 in the lead set have a tilt angle of twenty-two degrees, the next louver 64 has a tilt angle of thirty degrees, and the last two louvers 66 have a tilt angle of forty degrees. Again, the louvers 66'–62' in the trailing louver set decrease correspondingly. The primary significance of the two alternate embodiments is that, while less idealized, they are relatively easy to produce and test for comparison to both conventional fins and others, described below.

Figure 9:
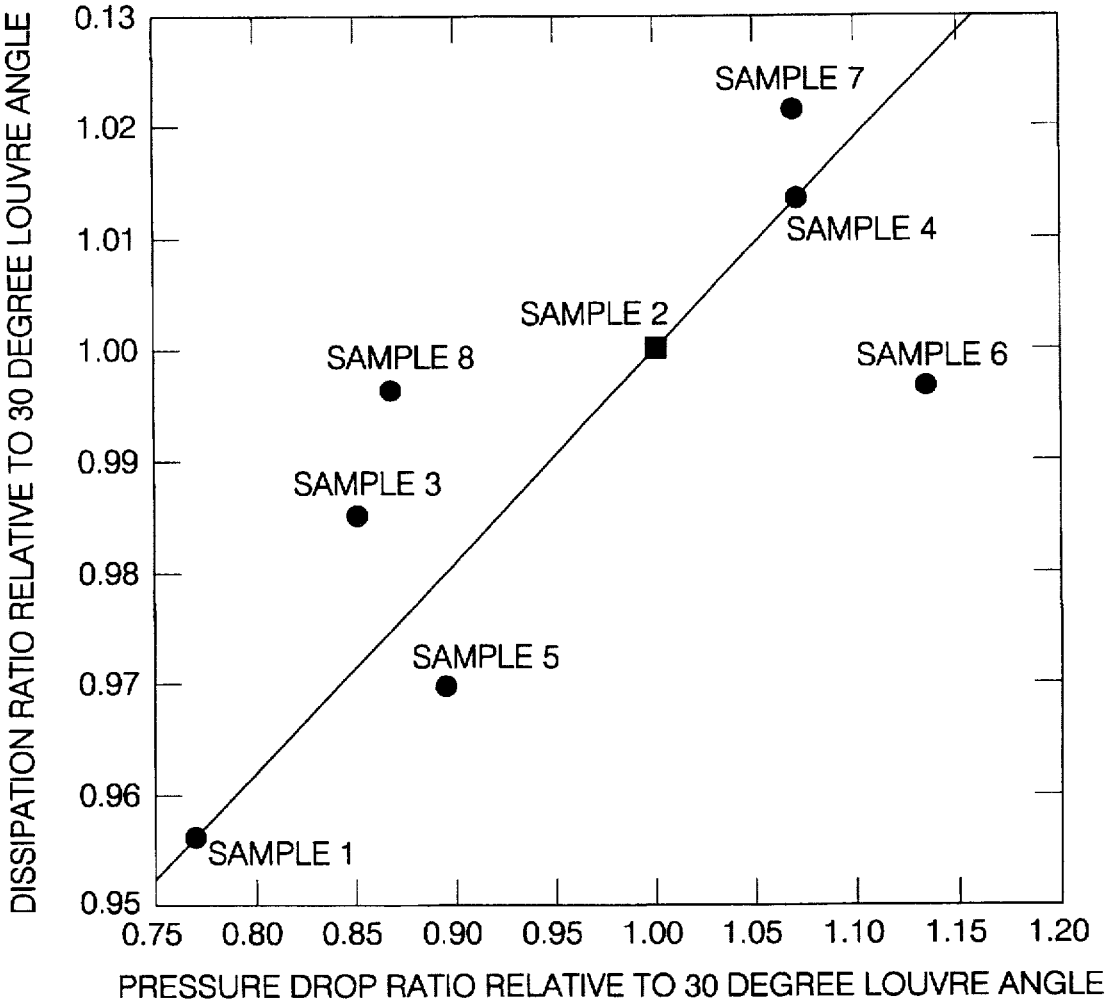
FIG. 9 is a graph comparing the performance of various embodiments of the invention as well as unrelated test samples to the prior art.

Referring next to the following table and to FIG. 9, eight samples of louvered fins with differing configurations were tested at a constant mass flow rate of air. Various parameters were measured, such as heat rejection rate, pressure drop, and the percentage changes therein as compared to a base sample. The samples 7 and 8 in both the table and in FIG. 9 are the two embodiments shown in FIGS. 7 and 8 and described above. Other samples were not intended as anything but test specimens. For example, samples 5 and 6 were made with exactly the opposite design intent as the invention. The steeper louvers were placed at the outside, farthest from the turn around rib, rather than on the inside, nearest the turn around rib, as in the invention. Other samples, numbers 3 and 4, are the simplest examples of what could be considered an embodiment of the invention. In samples 3 and 4, all of the louvers but for the two inside louvers (those next to the turn around rib) have the same, shallow tilt angle, and only the two inside louvers have a steeper, differing angle. Samples 1 and 2 are simply two different examples of the prior art, that is, all louvers have the same angle, and these were used as a base to which to compare the others. In the table, sample 1, in which all the louvers have a twenty-two degree tilt angle, was used as a base to which to compare the others. The percentage change in heat rejection was calculated, a change that is favorable when positive. As can be seen, the heat rejection rates did not vary a great deal, but the pressure drops did. Therefore, a dimensionless parameter was calculated in the last column by dividing the percentage change in heat rejection rate by the percentage change in pressure drop, and termed the "enhancement ratio". The higher the enhancement ratio, the better the fin performed, although the ratio is always less than one. Somewhat surprisingly, sample number 3, which changed only the inner two louvers' tilt angles, apparently performed very well. Sample 3 even appeared to perform better than sample 7, which was seemingly closer in configuration to the best performing sample 8. While the results are not totally understood at this point, the improvement in measurable performance is clear.

Effect of Louver Pattern On Performance
nominal core description 382.4 × 667.5 × 16.0 2.5
standard dissipation test point

| # | louver pattern | heat rejection BTU/min | air side delta P in $H_2O$ | % Change heat rejection | % Change air side delta P | enhancement ratio Hx/delta/P |
|---|---|---|---|---|---|---|
| 1 | uniform 22° louver angle | 3137.7 | 0.875 | base | base | base |
| 2 | uniform 30° louver angle | 3281.3 | 1.138 | 4.58% | 30.06% | .15 |
| 3 | uniform 22° w/30° inside | 3233.0 | 0.967 | 3.04% | 10.51% | .29 |
| 4 | uniform 22° w/40° inside | 3325.9 | 1.220 | 6.00% | 39.43% | .15 |
| 5 | uniform 22° w/30° outside | 3181.8 | 1.017 | 1.41% | 16.23% | .086 |
| 6 | uniform 22° w/40° outside | 3270.3 | 1.291 | 4.23% | 47.54% | .088 |
| 7 | variable 22-22-30-30-40 | 3351.9 | 1.218 | 6.83% | 39.20% | .174 |
| 8 | variable 22-22-30-40-40 | 3270.2 | 0.987 | 4.22% | 12.80% | .33 |

Referring next to FIG. 9, a graph of the same data from the table above presents a more visually apparent display of which samples were the better performers. Here, the thirty degree, constant angle fin was taken as the base case, and, for each other sample, the ratio of the change in heat dissipation for that sample compared to the base was graphed on the x axis. The ratio of the change in pressure drop relative to the base was graphed on the Y axis. Then, a line was drawn through the two samples that represent the prior art, that is, uniform tilt angle louvers of twenty-two and thirty degrees respectively. Graphically, those samples falling to the right of the line represent worse performers than the base, and those to the left of the base line, better performers. One of the other test samples fell coincidentally on the line. Samples 5 and 6, which were built with the opposite design intent of the invention, fell to the right of the base line. Samples 3, 8 and 7, representing embodiments of the invention, fell to the left, with sample eight, again, being the best performer.

Variations in the embodiments disclosed could be made. The basic louver pattern disclosed could be used with any heat exchanger having a generally regularly spaced series of parallel, flat fin walls exposed to any fluid or liquid flowing generally parallel to and over the fin walls, so as to exchange heat in either direction. The basic concept is not limited just to corrugated fins, just to air flow, or just to cooling. A simple louver pattern could be provided with only a single set of louvers like the lead set of louvers disclosed above, without the mirror imaged trailing set. This is seldom done in practice, but the fundamental principal of successive, incremental turning and deflection of the air flow would be the same. As already noted, as few as one or two of the inside louvers ("inside" meaning nearest the turn around rib) could be increased in tilt angle. Still, it would be basically as easy to configure the production tooling to create a louver pattern in which all of the louvers increased gradually in angle over the lead set and up to the turn around rib, and then decreased gradually in angle in mirror imaged fashion over the trailing set. The pitch of the louvers relative to one another in each set of louvers need not be absolutely constant, though it is unlikely that great variations in the pitch would be used. Therefore, it will be understood that it is not intended to limit the invention to just the embodiments disclosed.

We claim:

1. A heat exchanger fin having a series of substantially planar fin walls of substantially constant pitch with forced fluid flowing generally parallel to and over said fin walls, said fin walls having a length extending generally in the direction of said fluid flow and a width perpendicular thereto, the improvement comprising, a pattern of substantially rectangular louvers severed out of the plane of said fin walls and bent out at an angle relative to the plane of said fin walls about bending axes that are generally parallel to the length of said louvers but perpendicular to said fin wall length, said louvers having a substantially constant pitch and substantially identically located bending axes, but having an increasing angle, moving in the direction of said fluid flow, with the first louver of said pattern having the shallowest angle and the last louver having the steepest angle, whereby, as fluid flow is forced over said fin walls, it is deflected first through a fin wall by the shallower, initial louvers in that fin wall and then through successive adjacent fin walls by steeper louvers in successive fin walls, thereby deflecting the direction of said fluid flow in a successive, incremental fashion with thinner boundary layers relative to the surfaces of said louvers.

2. A heat exchanger corrugated cooling fin having a series of substantially constant pitch, planar fin walls with forced air flowing generally parallel to and over said fin walls, said fin walls having a length extending generally in the direction of said air flow and a width perpendicular thereto, the improvement comprising, a pattern of substantially rectangular louvers severed out of the plane of each of said fin walls and bent out at an angle relative to the plane of said fin walls about bending axes that are generally parallel to the length of said louvers but perpendicular to said fin wall length, said louvers having a substantially constant pitch and substantially identically located bending axes, but having an increasing angle, moving in the direction of said air flow, with the first louver of said pattern having the shallowest angle and last louver having the steepest angle and with intermediate louvers having intermediate angles, whereby, as air flow is forced over said fin walls, it is deflected first through a fin wall by the shallower, initial louvers in that fin wall and then through successive adjacent fin walls by successively steeper louvers in successive fin walls, thereby deflecting the direction of said air flow in a successive, incremental fashion with thinner boundary layers relative to the surfaces of said louvers.

3. A heat exchanger corrugated cooling fin having a series of substantially constant pitch, planar fin walls with forced air flowing generally parallel to and over said fin walls, said fin walls having a length extending generally in the direction of said air flow and a width perpendicular thereto, the improvement comprising, a pattern of substantially rectangular louvers severed out of the plane of each of said fin walls and bent out at an angle relative to the plane of said fin walls about bending axes that are generally parallel to the length of said louvers but perpendicular to said fin wall length, said louvers having a substantially constant pitch and substantially identically located bending axes, but with a continuously increasing angle, moving in the direction of said air flow, with the first louver of said pattern having the shallowest angle and the last louver having the steepest angle and with each louver having a steeper angle than the previous louver, whereby, as air flow is forced over said fin walls, it is deflected first through a fin wall by the shallower, initial louvers in that fin wall and then through successive adjacent fin walls by successively steeper louvers in successive fin walls, thereby deflecting the direction of said air flow in a successive, incremental fashion with thinner boundary layers relative to the surfaces of said louvers.

* * * * *